US007178392B2

(12) United States Patent
Dhruva et al.

(10) Patent No.: US 7,178,392 B2
(45) Date of Patent: Feb. 20, 2007

(54) DETERMINING THE PRESSURE OF FORMATION FLUID IN EARTH FORMATIONS SURROUNDING A BOREHOLE

(75) Inventors: Brindesh Dhruva, Missouri City, TX (US); Elizabeth B. Dussan, V., Ridgefield, CT (US); Aaron Jacobson, Paris (FR); Jagdish Shah, Wallingford, CT (US); Stephane Pierre, Chatenay-Malabry (FR); Fredrick A. Jenet, Altadena, CA (US); Michael G. Supp, Middlebury, CT (US); Jennifer Trittschuh, Pearland, TX (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 10/644,284

(22) Filed: Aug. 20, 2003

(65) Prior Publication Data

US 2005/0039527 A1 Feb. 24, 2005

(51) Int. Cl.
*E21B 47/06* (2006.01)

(52) U.S. Cl. ..... 73/152.51

(58) Field of Classification Search ..... None
See application file for complete search history.

(56) References Cited

U.S. PATENT DOCUMENTS 3,934,468 A 1/1976 Brieger
4,513,612 A 4/1985 Shalek
4,597,290 A * 7/1986 Bourdet et al. ..... 73/152.37

(Continued)

FOREIGN PATENT DOCUMENTS

EP 0 125 164 A1 11/1984

(Continued)

OTHER PUBLICATIONS

Basseville, M. et al. Finite Moving Average Control Charts. *Detection of Abrupt Changes: Theory and Application*. 2.1.3, pp. 38.

(Continued)

*Primary Examiner*—Hezron Williams
*Assistant Examiner*—Paul M. West
(74) *Attorney, Agent, or Firm*—John L. Lee; Vincent P. Loccisano; Jody Lynn DeStefanis

(57) ABSTRACT

A method for determining formation fluid pressure in earth formation surrounding a borehole wall uses a downhole probe coupled to a variable-volume cavity. The probe is driven into contact with formation at the borehole wall. The method includes expanding the volume of the cavity during a first period of time to establish fluid communication between tool fluid and formation fluid, by withdrawing a minimal amount of fluid from the formation. During a second period of time the tool pressure is allowed to equilibrate to formation pressure. When pressure equilibrium is established, formation fluid pressure is set equal to tool pressure. A preferred embodiment includes terminating expanding the volume of the cavity on detecting a break in the mud cake seal. An associated formation pressure tester tool includes an elongated body; a probe defining a formation fluid inflow aperture, an electromechanical assembly defining a variable-volume cavity, a pretest flow line coupling the aperture to the cavity, a pressure sensor coupled to the cavity; and downhole electronic means for controlling the expansion of the volume of the cavity.

23 Claims, 8 Drawing Sheets

U.S. PATENT DOCUMENTS

| | | | | |
|---|---|---|---|---|
| 4,745,802 | A | 5/1988 | Purfurst | |
| 4,860,581 | A | 8/1989 | Zimmerman et al. | |
| 4,893,505 | A | 1/1990 | Marsden et al. | |
| 4,936,139 | A | 6/1990 | Zimmerman et al. | |
| 4,949,575 | A | 8/1990 | Rasmus | |
| 5,095,745 | A | 3/1992 | Desbrandes | |
| 5,144,589 | A | 9/1992 | Hardage | |
| 5,233,866 | A | 8/1993 | Desbrandes | |
| 5,279,153 | A | 1/1994 | Dussan, V. et al. | |
| 5,303,582 | A | 4/1994 | Miska | |
| 5,353,637 | A | 10/1994 | Plumb et al. | |
| 5,517,854 | A | 5/1996 | Plumb et al. | |
| 5,555,945 | A | 9/1996 | Schultz et al. | |
| 5,602,334 | A | 2/1997 | Proett et al. | |
| 5,615,115 | A | 3/1997 | Shilling | |
| 5,622,223 | A | 4/1997 | Vasaquez | |
| 5,644,076 | A | 7/1997 | Proett et al. | |
| 5,703,286 | A | 12/1997 | Proett et al. | |
| 5,708,204 | A | 1/1998 | Kasap | |
| 5,741,962 | A | 4/1998 | Birchak et al. | |
| 5,770,798 | A | 6/1998 | Georgi et al. | |
| 5,799,733 | A | 9/1998 | Ringgenberg et al. | |
| 5,803,186 | A | 9/1998 | Berger et al. | |
| 5,934,374 | A | 8/1999 | Hrametz et al. | |
| 6,006,834 | A | 12/1999 | Skinner | |
| 6,026,915 | A | 2/2000 | Smith et al. | |
| 6,047,239 | A | 4/2000 | Berger et al. | |
| 6,058,773 | A | 5/2000 | Zimmerman et al. | |
| 6,147,437 | A | 11/2000 | Matsumoto et al. | 310/338 |
| 6,157,032 | A | 12/2000 | Into | 250/310 |
| 6,157,893 | A | 12/2000 | Berger et al. | 702/9 |
| 6,164,126 | A | 12/2000 | Ciglenec et al. | 73/152.01 |
| 6,178,815 | B1 | 1/2001 | Felling et al. | 73/152.19 |
| 6,230,557 | B1 | 5/2001 | Ciglenec et al. | 73/152.01 |
| 6,236,620 | B1 | 5/2001 | Schultz et al. | 367/82 |
| 6,301,959 | B1 | 10/2001 | Hrametz | 73/152.23 |
| 6,325,146 | B1 | 12/2001 | Ringgenberg et al. | 166/250.17 |
| 6,340,062 | B1 | 1/2002 | Skinner | 175/58 |
| 6,343,507 | B1 | 2/2002 | Felling et al. | 73/152.19 |
| 6,343,650 | B1 | 2/2002 | Ringgenberg et al. | 166/250.17 |
| 6,427,530 | B1 | 8/2002 | Krueger et al. | 73/152.46 |
| 2002/0185313 | A1 | 12/2002 | Jones et al. | 175/48 |

FOREIGN PATENT DOCUMENTS

| | | |
|---|---|---|
| WO | WO 01/33044 A1 | 5/2001 |
| WO | WO 02/08570 A1 | 1/2002 |

OTHER PUBLICATIONS

Desbrandes, R. Wireline Formation Testing: A New Extended Drawdown Technique. *Petroleum Engineer International*, (May 1991), pp. 40-44.

Desbrandes, R. et al. A New Concept in Wireline Formation Testing: Extended Drawdown. *CWLS Thirteenth Formation Evaluation Symposium* G (Sep. 11-13, 1991), pp. 1-25.

Joseph, J. A. et al. Unsteady-State Spherical Flow with Storage and Skin. *Society of Petroleum Engineers Journal*, SPE 12950 (Dec. 1985), pp. 804-822.

Moran, J. H. et al. Theoretical Analysis of Pressure Phenomena Associated with the Wireline Formation Tester. *Journal of Petroleum Tech*. SPE 177 (Aug. 1962), pp. 899-908.

Proett, M. A. et al. Supercharge Pressure Compensation with New Wireline Formation Testing Method. *SPWLA 37th Annual Logging Symposium*, Z (Jun. 16-19, 1996), pp. 1-14.

Stewart, G. et al. Interpretation of the Pressure Response of the Repeat Formation Tester. *Society of Petroleum Engineers*, Paper 8362.

* cited by examiner

DETERMINING THE PRESSURE OF FORMATION FLUID IN EARTH FORMATIONS SURROUNDING A BOREHOLE

This application is related to co-owned, co-pending U.S. application Ser. No. 10/248,535, filed 27 Jan. 2003. It is also related to co-owned, co-pending U.S. application Ser. No. 10/237,394, filed 9 Sep. 2002, and to co-owned, co-pending U.S. application Ser. No. 10/434,923, filed 9 May 2003, that is a continuation-in-part of U.S. application Ser. No. 10/237,394. These previously filed applications are incorporated herein by reference.

FIELD OF THE INVENTION

The present invention relates generally to the field of oil and gas exploration. More particularly, the invention relates to methods for determining at least one property of an earth formation surrounding a borehole using a formation tester.

BACKGROUND OF THE INVENTION

The term "wireline formation tester" is the generic name in the petroleum industry for a wireline logging tool used for determining formation fluid pressure and other parameters in a reservoir. A prior art wireline formation tester typically includes a formation pressure tester tool having a probe with a pretest chamber and a hydraulically-driven pretest piston. A pressure sensor is coupled to measure tool pressure.

Measurement of formation fluid pressure by a formation tester may be repeated once or twice without changing the position of the probe. Proper placement of the formation tester requires lowering the formation tester into the well and pressing the probe of the pressure tester tool against the borehole wall. The measurement procedure includes a "draw-down" procedure followed by a "build-up" procedure.

Before drawdown, the probe is pressed against the mud cake on the borehole wall. During drawdown, a small amount of formation fluid (typically 10 cc) is extracted from the reservoir. The prior art draw-down procedure includes establishing hydraulic communication between tool fluid and formation fluid (by retracting the pretest piston in the pretest chamber to reduce the tool pressure and break the mud cake seal), verifying good hydraulic communication between tool fluid and formation fluid using the pressure sensor, and verifying good hydraulic isolation between tool fluid and borehole fluid using the pressure sensor.

Immediately following drawdown, the pretest piston is stationary in the retracted position and fluid in the pretest chamber is at a pressure below the pressure of formation fluid.

Build-up includes allowing a build-up period to establish pressure equilibrium between tool fluid and formation fluid. During build-up, the pretest piston remains stationary in the retracted position. Formation fluid flows from the formation into the tool because formation fluid pressure is higher than tool pressure. Continued inflow allows tool pressure to build up until equilibrium is established. When equilibrium is established, tool pressure equals reservoir pressure. The changing pressure in the tool is monitored by the pressure sensor. The build-up procedure includes waiting for equilibrium to be established; and setting pressure of formation fluid equal to the measured tool pressure.

When using wireline formation testers for determining formation fluid pressure, especially in low permeability formations, it is most desirable that equilibrium be established within a short time. If the formation tester is set at a particular location for too long a time, it could stick in the borehole and become difficult to remove. Fear of the tool sticking in the borehole is a major concern and is frequently cited as the main reason for not using wireline formation testers more often. For this reason, the tester is usually allowed to remain on the borehole wall for no more than a limited period of time. The limited period of time varies widely depending on the nature of the formation and the downhole borehole pressure, temperature, etc. Because wireline formation testers often fail to reach equilibrium within the time allowed, several data processing extrapolation techniques have been developed for estimating reservoir pressure from a time-series of pressure measurements. These techniques, to the extent they provide accurate estimates, avoid the need to wait for equilibrium to be established. However, these techniques are not generally viewed as reliable predictors of actual formation fluid pressure.

SUMMARY OF THE INVENTION

The invention provides a method and apparatus for determining formation fluid pressure in earth formation surrounding a borehole, using a downhole probe coupled to a pretest piston pump, the pump having a pretest chamber and a pretest piston, the chamber and piston defining a variable-volume pretest cavity.

In operation, the method requires pressing the probe into contact with formation at the borehole wall. The preferred embodiment includes expanding the volume of the cavity during a first period of time to establish fluid communication between tool fluid and formation fluid by breaking a mud cake seal. Pressure equilibrium is established during a second period of time by allowing formation fluid to flow into the tool. When pressure equilibrium is established, formation fluid pressure is set equal to tool pressure.

Expanding the volume of the cavity during a first period of time to establish fluid communication includes expanding the volume of the cavity to draw only the necessary volume of formation fluid into the tool to establish and validate fluid communication, thereby minimizing pressure overshoot.

A preferred embodiment of the method for determining formation fluid pressure in earth formation surrounding a borehole, the borehole defining a borehole wall, includes pressing a probe into contact with mud cake and formation at the borehole wall; expanding a variable-volume cavity in fluid communication with the probe during a draw-down period to break a mud cake seal at the probe; terminating expanding the volume of the cavity on detecting a break in the mud cake seal; allowing fluid flow during a build-up period to establish pressure equilibrium between tool fluid and formation fluid; measuring tool pressure; and setting formation fluid pressure equal to tool pressure.

Expanding the volume of the cavity includes expanding the volume of the cavity during the draw-down period at a selected constant rate in the range of 3–160 cc/minute. A preferred rate is 5 cc/minute.

Preferably, detecting a break in the mud cake seal includes measuring tool pressure and detecting an abrupt change in tool pressure, and detecting an abrupt change in tool pressure includes using a finite moving average (FMA) algorithm on the measured tool pressure and its first and second time derivatives.

Alternatively, using a formation pressure tester tool in fluid communication with a formation, detecting a break in the mud cake seal includes detecting a difference between a measured tool pressure and a corresponding tool pressure from a reference tool pressure profile, wherein the reference tool pressure profile is measured in a previous drawdown with the tool isolated from the formation.

The invention further provides a formation pressure tester tool for determining formation fluid pressure in earth formation surrounding a borehole. The preferred embodiment includes an elongated body adapted for downhole operation, and a probe, extending from the elongated body, adapted to accept formation fluid from the borehole wall. A pretest piston pump, the pump having a pretest chamber and a pretest piston, the chamber and piston defining a variable-volume pretest cavity moveable pretest piston, defines a variable-volume cavity. The variable-volume cavity is fluid-coupled to the probe via a flexible conduit. Pressure measuring means is fluid-coupled to the variable-volume cavity for measuring tool pressure. Control means for controlling expanding the variable-volume cavity and terminating expanding the volume of the cavity on detecting a break in the mud cake seal is electrically coupled to the piston pump.

The formation pressure tester tool preferably includes an elongated body adapted for downhole operation; a probe, extendable from the elongated body, the probe defining a formation fluid inflow aperture; an electromechanical assembly defining a variable-volume cavity; a pretest flow line coupling the formation fluid inflow aperture to the cavity; pressure measuring means, pressure-coupled to the cavity for measuring tool pressure; and control means for actively controlling the rate of change of volume of the cavity.

Preferably, the tool includes an electromechanical assembly with a pretest chamber and an electrically driven pretest piston; a control means with an electric motor, a gearbox, and an electromechanically driven roller screw planetary system; a dedicated probe; a flexible conduit; downhole programmable control electronics; and a constant-volume flow line has a volume in the range 20–30 cc.

DETAILED DESCRIPTION

General

The invention provides a method and tool for determining the pressure of formation fluid in earth formation surrounding a borehole more quickly and potentially more accurately than methods used in existing wireline formation testers. By determining the pressure more quickly, the invention reduces the risk of the tool sticking in the borehole.

In particular, the method in a preferred embodiment includes actively terminating the expansion of the volume of the cavity of a pretest chamber during the "draw-down" period of a method similar to the prior art method described above.

Actively terminating the expansion of the volume of the cavity upon detection of an abrupt change in pressure prevents excessive pressure overshoot. See "overshoot" in FIGS. 5 and 6. "Pressure overshoot" refers to the tool pressure always being less than the formation pressure $P_f$ at the conclusion of drawdown. Withdrawing fluid from the formation into the tool requires that the tool pressure be less than the formation pressure. Minimizing overshoot requires that overshoot be no more than required to break the mud cake seal, and to create hydraulic communication. Minimizing pressure overshoot also minimizes the volume of fluid withdrawn from the formation.

Minimizing overshoot creates the benefit of minimizing the time it takes the pressure in the formation pressure tester tool (herein below referred to as the "tool pressure") to equilibrate to the formation fluid pressure (herein below referred to as the "formation pressure"). Preferably, a low-volume flow line is used.

Minimizing the volume of fluid withdrawn from the formation, and using a low-volume flow line are also believed to provide a more accurate measurement of formation pressure.

Apparatus of the Invention

Figure 1:
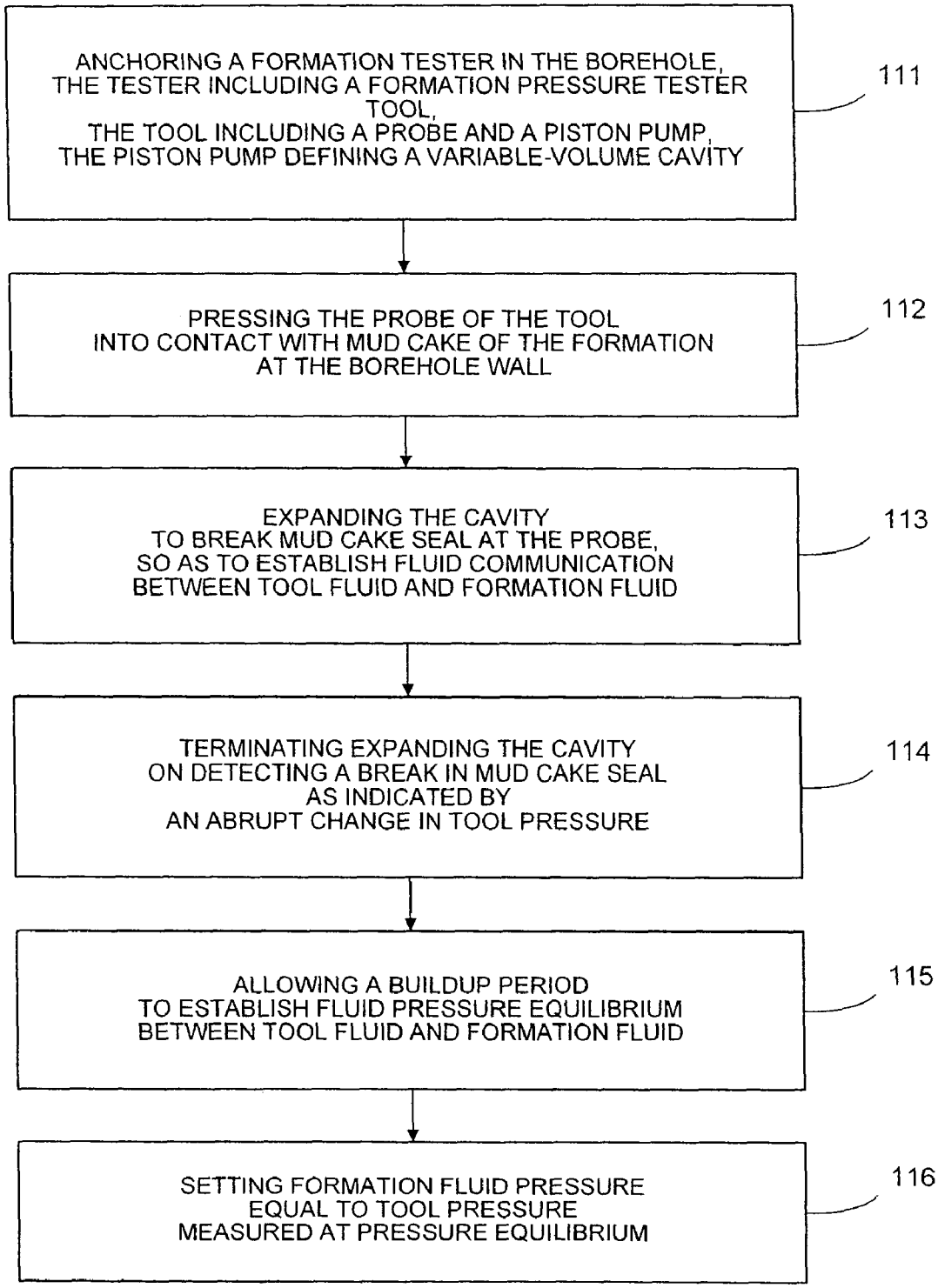
FIG. 1 is a flowchart of a first preferred embodiment of the method of the invention, wherein the variable-volume cavity is expanded at a predetermined constant rate during drawdown, and expansion is terminated on detecting a break in mud cake seal.
Figure 2:
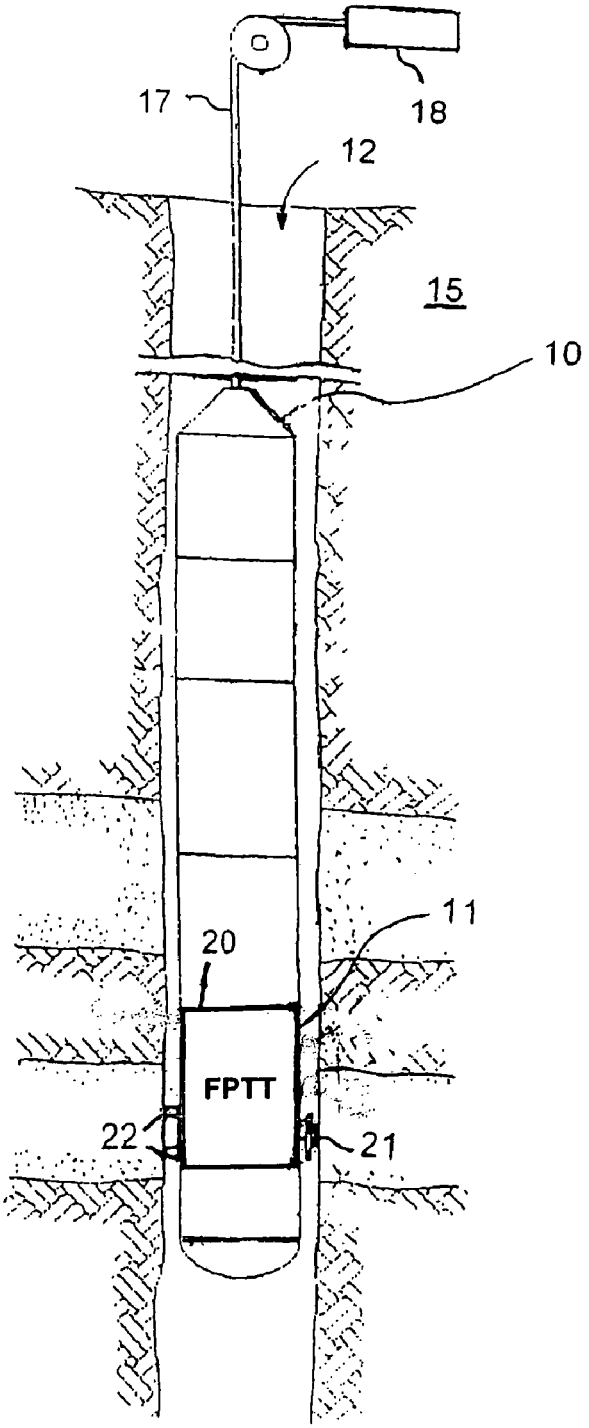
FIG. 2 is a schematic illustration of the formation fluid pressure measurement tool of a first preferred embodiment located in a wireline tool.

FIG. 2 shows formation pressure tester tool 20 of the invention located within wireline tester 10. The wireline tester is shown located in borehole 12, suspended from logging cable 17, and coupled electrically to surface system 18 via electrical wires in the logging cable.

FIG. 2 shows probe 21 protruding from elongated body 11 and in physical contact with formation 15 at one side of the borehole. With probe 21 in physical contact with the borehole wall, formation pressure tester tool is 20 is held stationary in the borehole by two distal hydraulic anchoring pistons 22 exerting counter-force against the opposite side of the borehole. Pressure sensor 36 is coupled to measure pressure in the variable-volume cavity of pretest chamber 30. Downhole programmable control electronics 45 controls the sequencing and timing of the steps of the method by timing measurements from pressure sensor 36 and by controlling pretest piston pump 23. The pretest piston pump operates to control the volume of a variable-volume cavity (item 33 in FIG. 3). In the preferred embodiment the sampling rate for pressure measurements may be set as high as 120 Hz.

Figure 3:
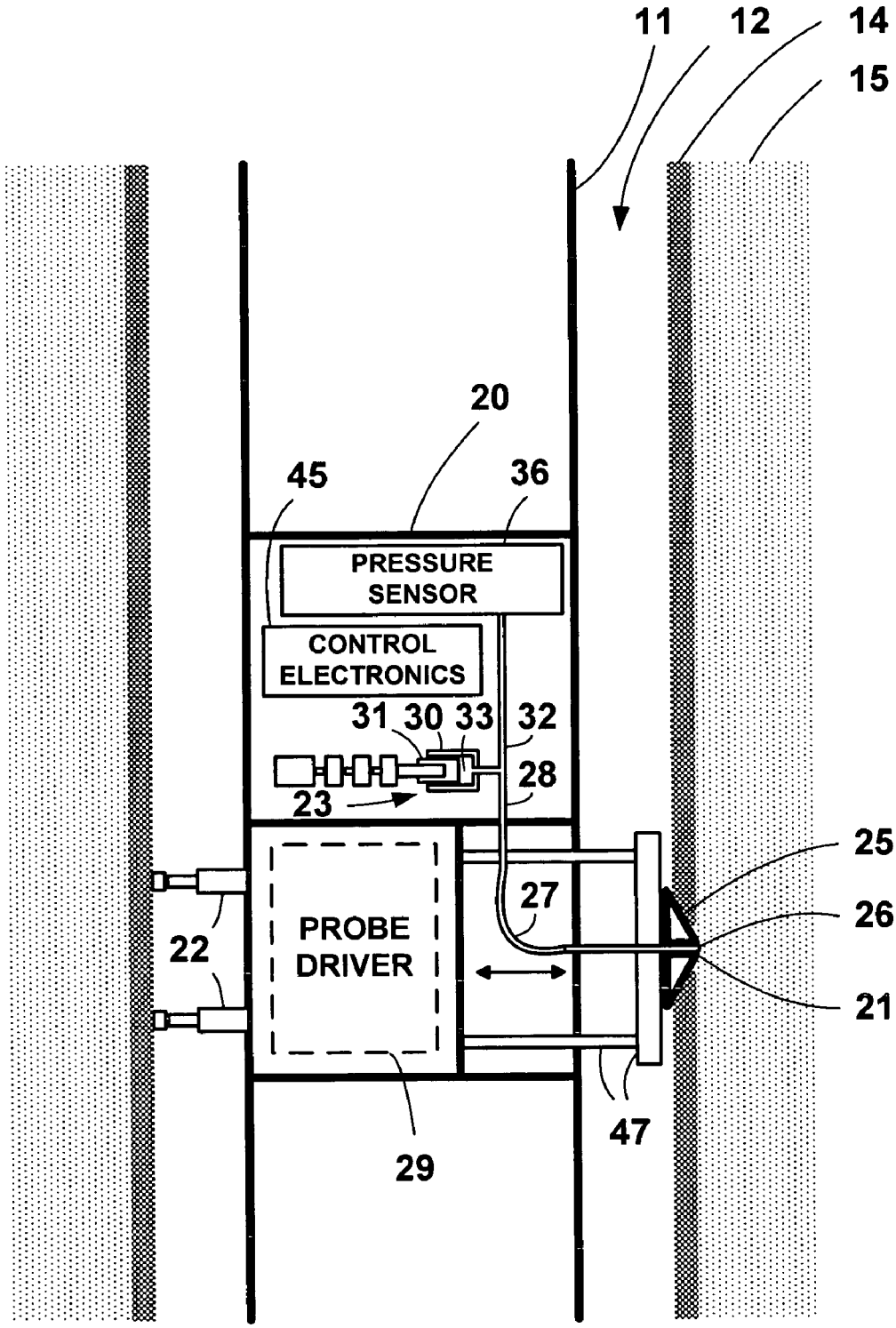
FIG. 3 is a schematic illustration of the measurement tool of FIG. 2 showing the main components of the first preferred embodiment.

FIG. 3 shows probe 21 pressed against mud cake 14 by hydraulic anchoring pistons 22, extending from probe driver 29. Electronics 45 controls pistons 22 via probe driver 29. Downhole programmable control electronics 45 also controls the pushing of frame 47. Hydraulic communication between the formation tester and the formation is achieved by breaking the mud cake seal at the inflow aperture 26 of probe 21. Resilient packer 25 isolates the fluid inside the formation tester from borehole pressure. Aperture 26 is coupled to variable-volume cavity 33 via flexible conduit 27 (of pretest flow line 32) and rigid conduit 28. Flexible conduit 27 accommodates the advancing and retracting motion of probe 21 in the direction of the double arrow in FIG. 3.

In the first preferred embodiment, the volume of the pretest flow line is in the range 20–120 cc.

Pretest piston 31 is used to vary the tool pressure $P_t$. Pressure $P_t$ exists in probe 21, in conduits 27 and 28, and in cavity 33 as measured by pressure sensor 36. It can be seen from FIG. 3 that the pressure measured by pressure sensor 36, and the pressure in cavity 33, are both equal to the pressure at the probe because they are both in good fluid communication via conduits 27 and 28.

Figure 4:
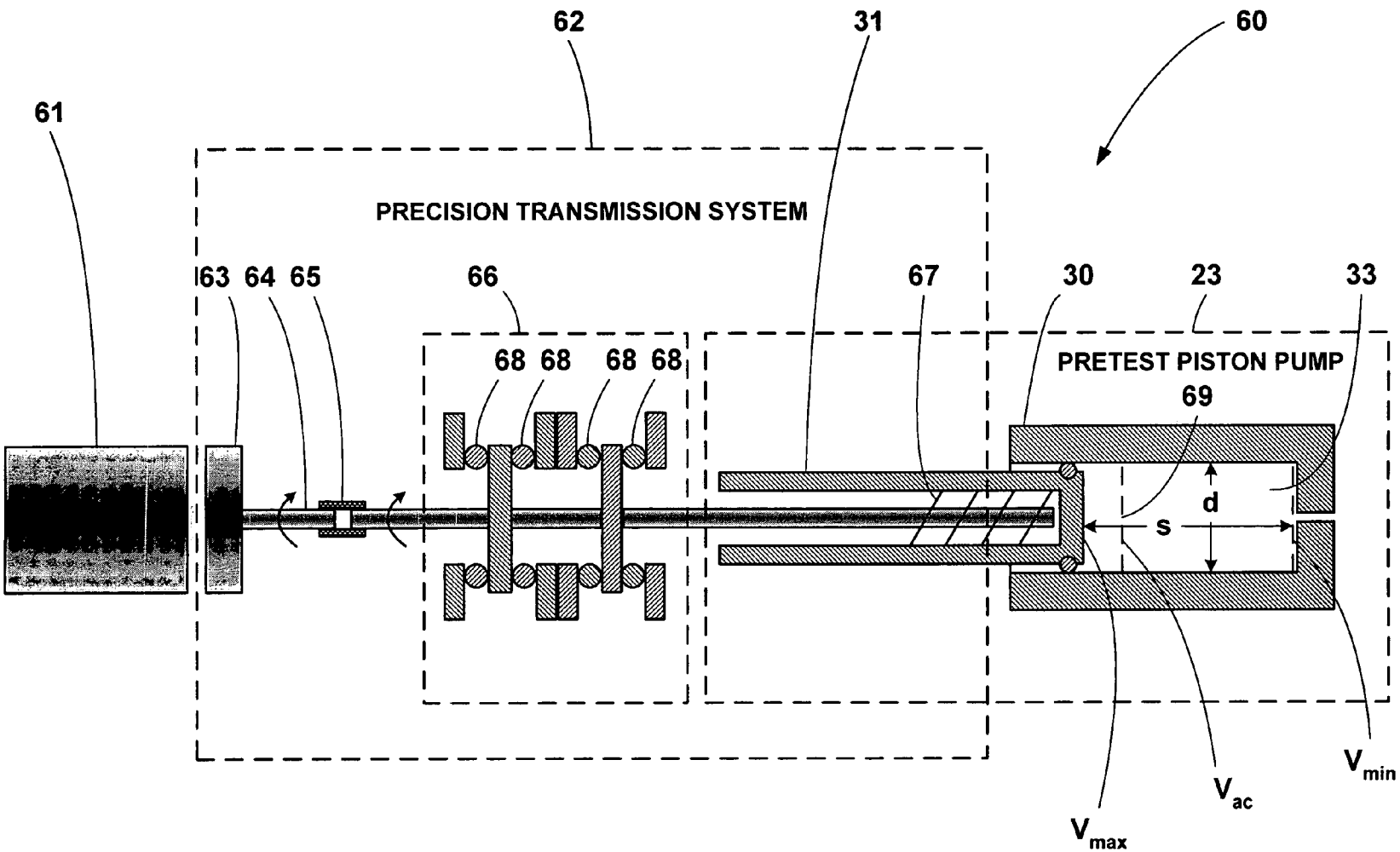
FIG. 4 is a schematic illustration of the measurement tool of FIG. 2, showing detail of the electromechanical assembly.

FIG. 4 shows detail of electromechanical assembly 60, including pretest piston pump 23 and its variable-volume cavity 33. FIG. 4 also shows pretest piston 31 and its associated piston drive train. The piston drive train includes electric motor 61 and precision transmission system 62. Transmission system 62 includes reducer 63, shaft 64, coupling 65, bearings 66 with ball races 68, and roller screw planetary system 67. Assembly 60 is electromechanical (in contrast to hydraulic assemblies performing a similar function in the prior art) for precision control of the amount of formation fluid drawn into the pretest chamber.

FIG. 4 also shows detail of pretest piston pump 23. Piston pump 23 includes cylindrical pretest chamber 30 and pretest piston 31. Pretest chamber 30 and pretest piston 31 together define variable-volume cavity 33. The swept volume of variable-volume cavity 33 of the preferred embodiment is the swept volume of pretest chamber 30. FIG. 4. shows chamber 30 having a diameter "d" of 30 mm and piston 31 having a maximum stroke "s" of 70 mm. As shown in FIG. 4, piston 31 fully retracted defines a maximum cavity volume $V_{max}$. Piston 31 fully extended defines a minimum cavity volume $V_{min}$. Piston 31 at buildup position 69 defines variable-volume cavity 33 having a buildup cavity volume equal to $V_{ac}$. (See FIGS. 4 and 5).

FIG. 4 also shows detail of precision transmission system 62. FIG. 4 shows that transmission system 62 includes reducer 63 and roller screw planetary system 67. In a preferred embodiment reducer 63 is a conventional gearbox reducer that provides a 75:1 reduction of speed. The roller screw planetary system 67 that drives pretest piston 31 provides an additional reduction of speed. This electromechanical drive system provides precision "push and pull" capability. Output shaft 64 of the gearbox is coupled via coupling 65 and bearings 66 to roller screw planetary system 67. In the preferred embodiment of the formation pressure tester tool, the pretest chamber, the pretest piston, and the electromechanical assembly provide a selectable drawdown rate covering the range of 3–160 cc/minute.

The use of downhole programmable control electronics to control sequencing and timing in the present invention avoids the sampling rate limitations incurred when using surface electronics. The use of surface electronics imposes severe sampling rate limitations because of the inherently narrow bandwidth of the logging cable.

The use of flexible conduit, rather than the more elaborate structure of the typical prior art probe, serves to avoid volume changes during probe-setting.

The pretest flow line has a volume in the range 20–120 cc. Under benign conditions, the lower end of this range is preferable.

The combination of dedicated probe and flexible conduit makes a constant-volume flow line. A constant-volume flow line is beneficial because it eliminates a significant source of disturbance caused by tool movement during pretest.

Alternative Embodiments

For applications in which a lower pretest flow line volume is beneficial, the lower volume is provided by locating probe 21 between pressure sensor 36 and variable-volume cavity 33.

Figure 7:
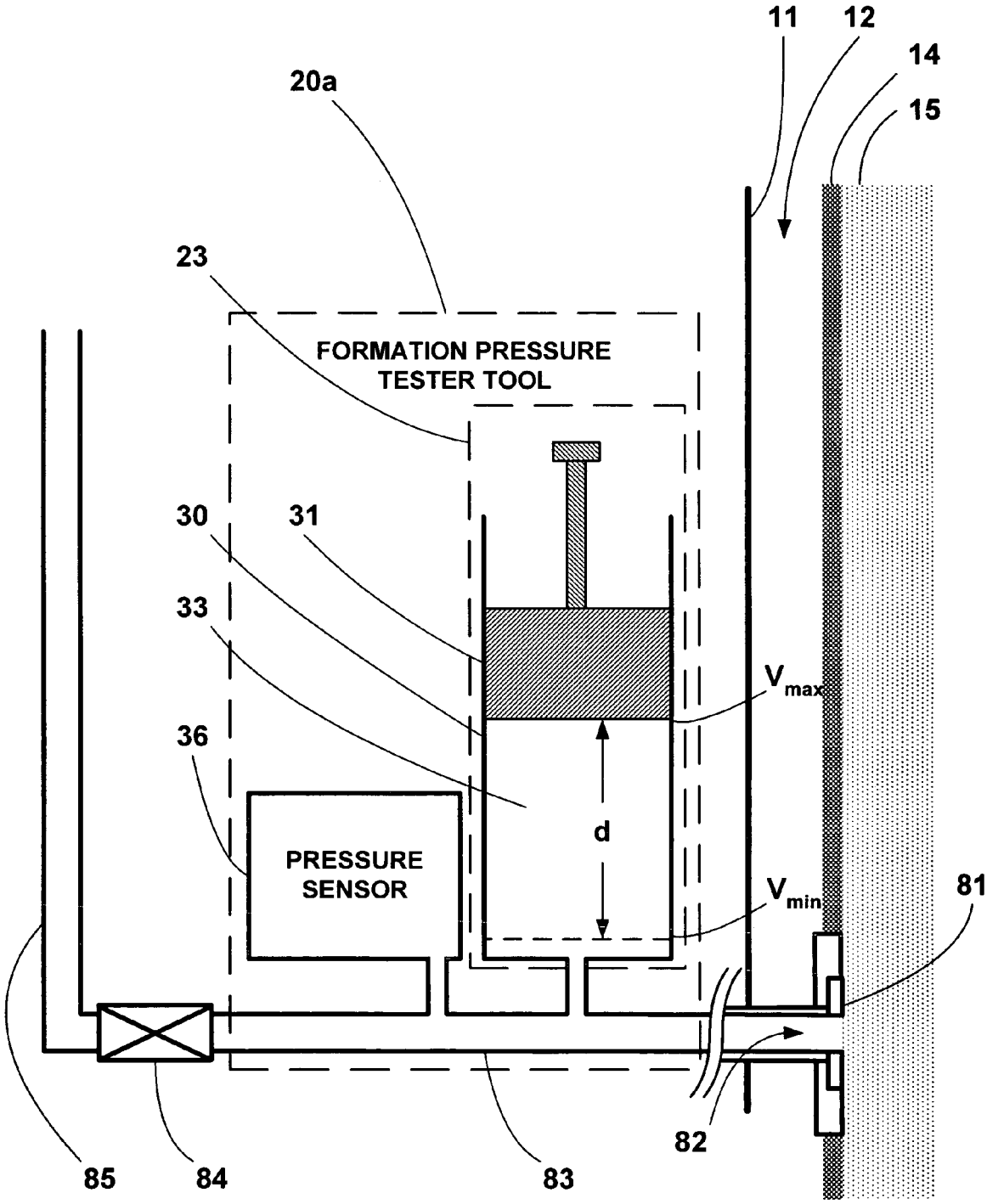
FIG. 7 is a schematic illustration of a first alternative to the measurement tool of FIG. 2, showing a prior art probe, the tool tapped into the sample conduit.
Figure 8:
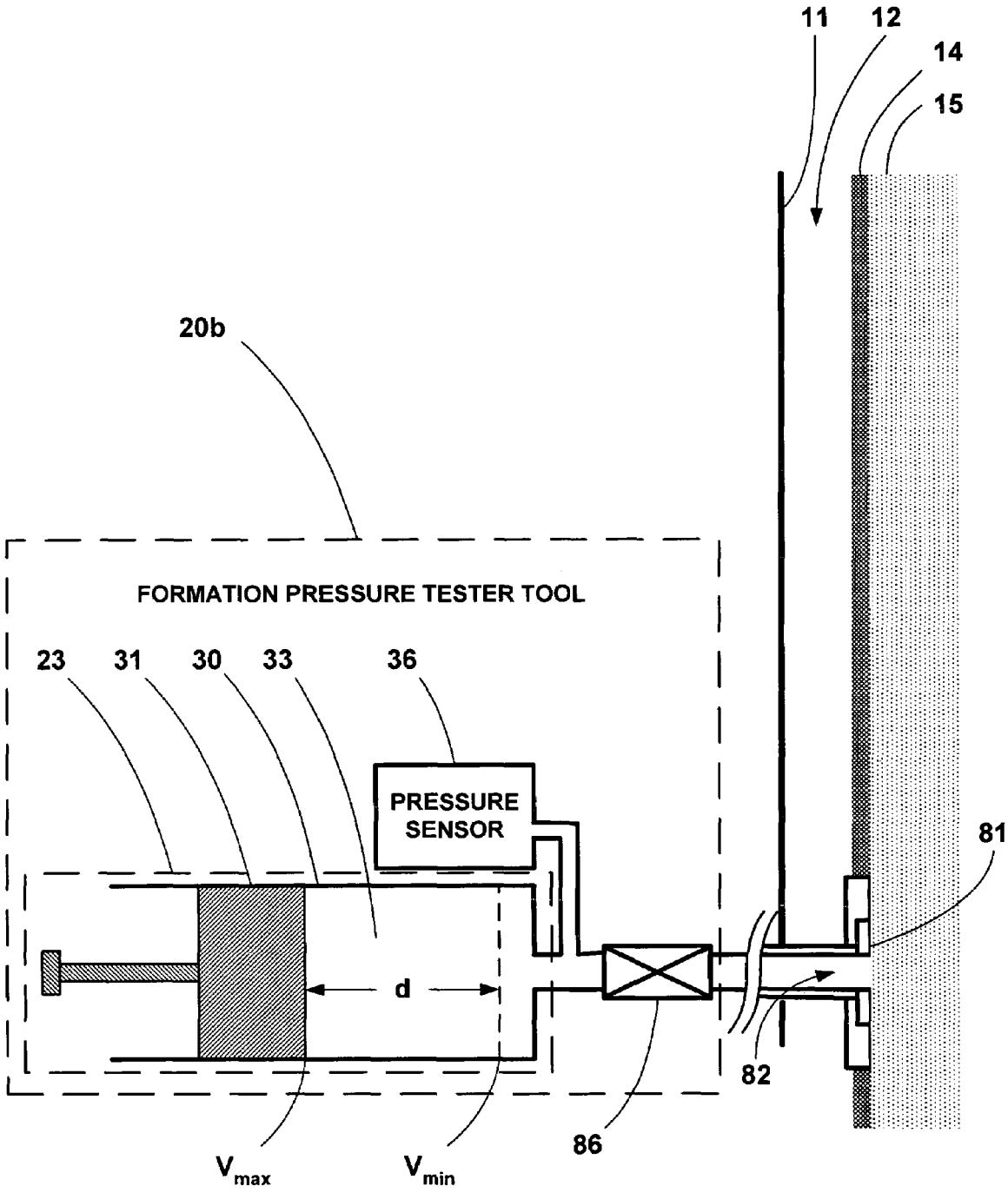
FIG. 8 is a schematic illustration of a second alternative to the measurement tool of FIG. 2, showing a probe of the type used in a prior art sampling system but not shared with a sampling system.

First and second alternative embodiments are shown in FIGS. 7 and 8 respectively. FIG. 7 is a schematic illustration of a first alternative embodiment, tool 20*a*, using prior art probe 81 having formation fluid inflow aperture 82. Tool 20*a* is tapped into pretest flow line 83 that leads to isolation valve 84 and sample riser 85.

FIG. 8 is a schematic illustration of a second alternative embodiment tool 20*b*, using probe 81 of the type used in a prior art sampling system but not shared with a sampling system. Isolation valve 86 is used to isolate tool pressure from external pressures in the making of the stored pressure profile of the method illustrated in FIG. 6.

Although originally configured for wireline application, the formation pressure tester tool of the invention may also be incorporated into a logging while drilling (LWD) tool.

The Method, Draw-down Phase

In the preferred embodiment, drawdown is accomplished by actively expanding cavity volume $V_c$ to establish fluid communication between tool fluid and formation fluid. In the preferred embodiment, the volume of the cavity is expanded at a controlled predetermined constant rate. Alternatively, a control algorithm may be used based on the first time-derivative of tool pressure.

Figure 5:
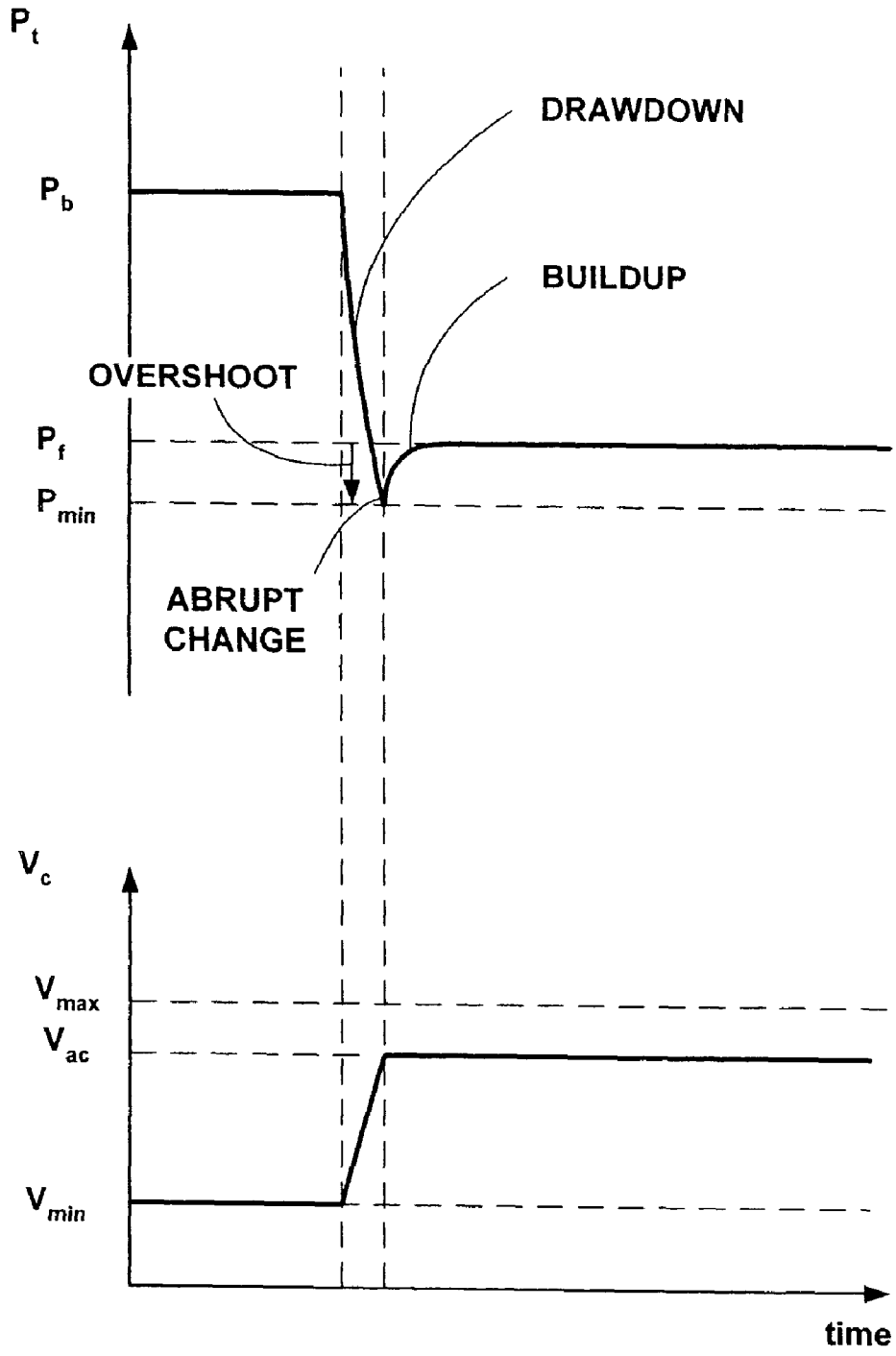
FIG. 5 is a graph illustrating the rate of change of cavity volume and the resulting rate of change of tool pressure of a first preferred embodiment of the method of the invention.

FIG. 5 illustrates the rate of change of cavity volume and the resulting rate of change of tool pressure $P_t$ of a first preferred embodiment of the method of the invention. $P_f$ is the formation pressure. $P_{min}$ is the minimum tool pressure during drawdown. $P_b$ is the borehole pressure. $V_{max}$ is the maximum cavity volume, corresponding to a maximum volume drawdown. $V_{min}$ is a minimum cavity volume corresponding to a zero volume drawdown. The location of $V_{ac}$ in FIG. 4 indicates a typical cavity volume when drawdown is curtailed upon detection of an abrupt change in tool pressure $P_t$, indicating a break in the mud cake seal.

A first preferred embodiment of the method for detecting a break in the mud cake seal includes detecting an abrupt change in tool pressure $P_t$.

With reference to FIG. 5, as cavity volume $V_c$ expands, the increases in $V_c$ and the decreases in $P_t$ occur smoothly until the mud cake begins to detach from the borehole wall. When this happens, hydraulic communication has been established with the reservoir. This event is marked by an abrupt change in the character of $P_t$. Drawdown is terminated as soon as this change in character of $P_t$ occurs. The abrupt change may be detected by any one of a number of known mathematical methods of detecting an abrupt change. In a preferred embodiment, drawdown is terminated on detection of an abrupt change in the value $P_t$, or in the value of one its first or second time derivatives using a finite moving average (FMA) algorithm. This algorithm is discussed in "Detection of Abrupt Changes: Theory and Application", Michele Bassevilee and Igor Nikiforov, a book, available from P T R Prentice Hall, Englewood Cliffs, N.J. 07631. The FMA algorithm is discussed under 2.1.3 "Finite Moving Average Control Charts" on page 38.

In contrast, a typical prior art drawdown involves expanding the enclosed volume at a constant rate (specified by the operator) and in amount usually between 5 cc to 20 cc. This practice always reduces $P_t$ significantly below $P_f$, thus necessitating a time-consuming build-up phase.

Figure 6:
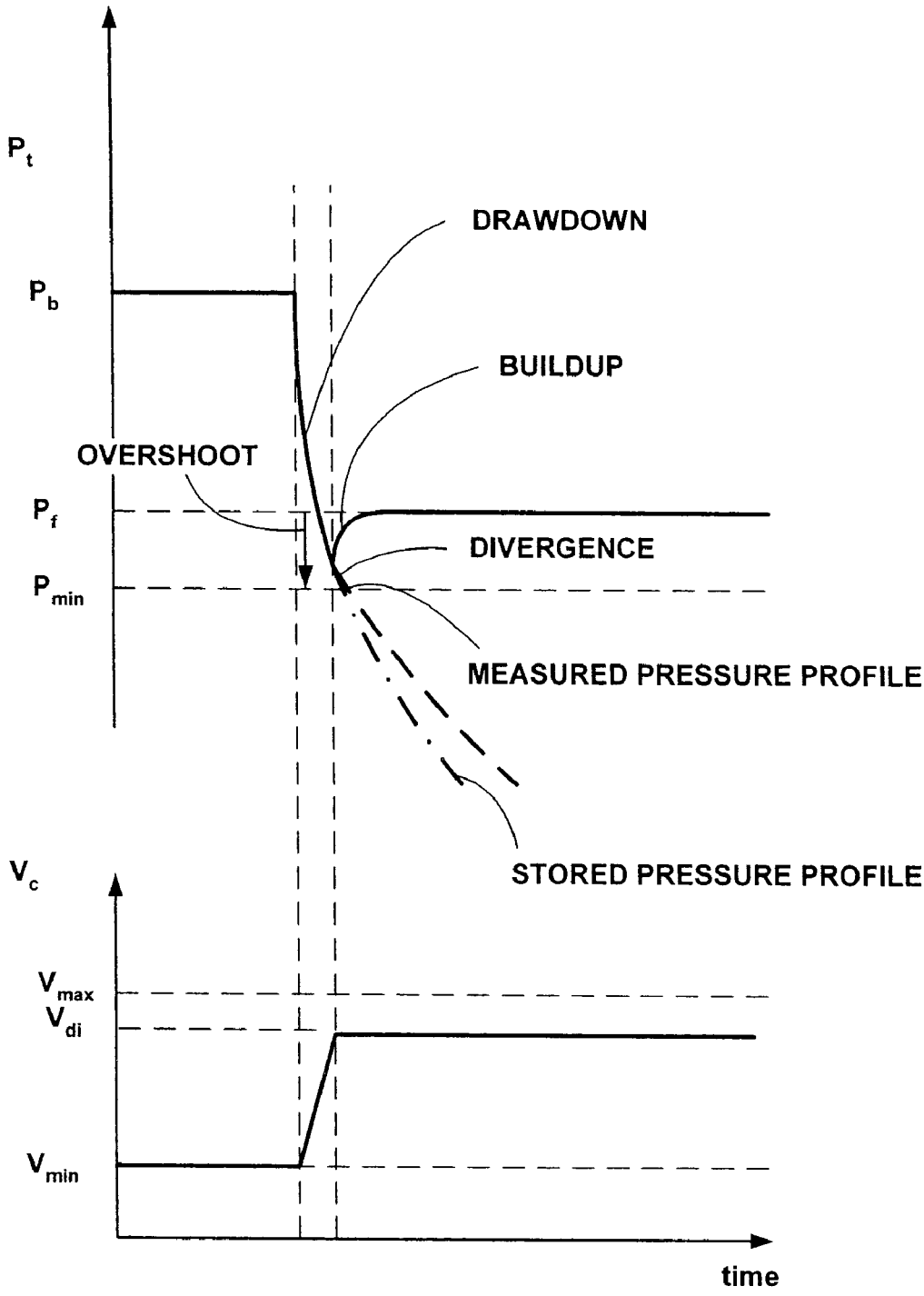
FIG. 6 is a graph illustrating the rate of change of cavity volume and the resulting rate of change of tool pressure of a second preferred embodiment of the method of the invention.

A second preferred embodiment, illustrated in FIG. 6, of the method for detecting a break in the mud cake seal includes detecting a divergence (at cavity volume $V_{di}$ in FIG. 6) between a measured tool pressure and a corresponding tool pressure from a reference tool pressure profile. In this embodiment the reference tool pressure profile is derived from measurements in a previous drawdown with the tool isolated from the formation.

What is claimed is:

1. A method for determining formation fluid pressure in earth formation surrounding a borehole, the borehole defining a borehole wall, the borehole wall covered with mud cake forming a mud cake seal, the method comprising:

providing a tool defining a probe and a variable-volume pretest cavity fluid-coupled to the probe;

pressing the probe into contact with the mud cake;

expanding the volume of the cavity to draw fluid from the formation in sufficient amount to produce a break in the mud cake seal during a draw-down period;

detecting an occurrence of a break in the mud cake seal by detecting an abrupt change in cavity pressure;

holding constant the volume of the cavity immediately after detecting the occurrence of the break in the mud cake seal, for a sufficient build-up period to establish pressure equilibrium between cavity fluid and formation fluid;

measuring pressure in the cavity;

setting formation fluid pressure equal to measured pressure; and minimizing the volume of fluid drawn, thereby preventing excessive overshoot;

such that formation pressure is determined more quickly and the risk of the tool sticking in the borehole is reduced.

2. A method according to claim 1, wherein minimizing the volume of fluid drawn includes using a low-volume flow line.

3. A method according to claim 1, wherein detecting the abrupt change includes using a finite moving average (FMA) algorithm on a function of cavity pressure.

4. A method according to claim 3, wherein the function of cavity pressure includes cavity pressure.

5. A method according to claim 3, wherein the function of cavity pressure includes a first derivative of cavity pressure.

6. A method according to claim 3, wherein the function of cavity pressure includes a second derivative of cavity pressure.

7. A method according to claim 1, wherein detecting an occurrence of a break in the mud cake seal includes detecting a difference between a measured cavity pressure and a corresponding cavity pressure from a reference cavity pressure profile.

8. A method according to claim 7, wherein the reference cavity pressure profile is measured in a previous drawdown with the cavity isolated from the formation.

9. A method according to claim 1, further comprising:

expanding the volume of the cavity during the draw-down period at a predetermined constant rate.

10. A method according to claim 9, wherein the predetermined constant rate is within the range of 3–160 cc/minute.

11. A method according to claim 10, wherein the predetermined constant rate is approximately 5 cc/minute.

12. A tool for determining formation fluid pressure in earth formation surrounding a borehole, the borehole defining a borehole wall, the borehole wall covered with mud cake forming a mud cake seal, the tool comprising:

an elongated body adapted for downhole operation;

a probe, extendable from the elongated body, the probe defining an inflow aperture and a low-volume flow line;

a pretest piston pump defining a variable-volume pretest cavity coupled to the inflow aperture via the low-volume flow line;

a) means for expanding the volume of the pretest cavity in sufficient amount to produce a break in the mud cake seal, b) means for detecting an occurrence of a break in the mud cake seal, c) means for holding constant the volume of the cavity immediately after detecting the occurrence of the break in the mud cake seal, for a sufficient build-up period to establish pressure equilibrium between pretest cavity fluid and formation fluid; and d) means for minimizing the volume of fluid drawn, thereby preventing excesive overshoot, such that formation pressure is determined more quickly and the risk of the tool sticking in the borehole is reduced, and a pressure sensor coupled to measure pressure in the pretest cavity.

13. A tool according to claim 12, wherein the control means includes an electromechanically driven roller screw planetary system.

14. A tool according to claim 13, wherein the control means further includes an electrically driven gearbox coupled to drive the roller screw planetary system.

15. A tool according to claim 12, wherein the control means includes downhole programmable control electronics coupled to control an electromagnetic assembly.

16. A tool according to claim 12, wherein the low-volume flow line is a constant-volume low-volume flow line.

17. A tool according to claim 16, wherein the constant-volume low-volume flow line is associated with a dedicated probe.

18. A tool according to claim 16, wherein the constant-volume low-volume flow line includes a flexible conduit.

19. A tool according to claim 16, wherein the constant-volume low-volume flow line has a volume in the range 20–120 cc.

20. A tool according to claim 12, wherein the probe is located between the pressure measuring means and the variable-volume pretest cavity.

21. A tool according to claim 12, further comprising a sample riser coupled to the cavity, and an isolation valve located between the variable-volume pretest cavity and the sample riser.

22. A tool according to claim 12, further comprising an isolation valve located between the cavity and the formation fluid inflow aperture.

23. A tool according to claim 12, wherein said control means includes means for terminating expansion of the volume of the cavity on detecting an occurrence of a break in a mud cake seal.

* * * * *